United States Patent [19]

Stephens

[11] 4,253,482

[45] Mar. 3, 1981

[54] HYDRAULIC VALVE HAVING PRESSURE COMPENSATED DEMAND FLOW

[75] Inventor: William T. Stephens, New Brighton, Minn.

[73] Assignee: Gresen Manufacturing Company, Spring Park, Minn.

[21] Appl. No.: 17,193

[22] Filed: Mar. 5, 1979

Related U.S. Application Data

[63] Continuation of Ser. No. 870,765, Jan. 19, 1978, abandoned, which is a continuation of Ser. No. 793,381, May 4, 1977, abandoned, which is a continuation of Ser. No. 631,021, Nov. 12, 1975, abandoned, which is a continuation of Ser. No. 509,834, Sep. 27, 1975, abandoned, which is a continuation of Ser. No. 231,174, Mar. 2, 1972, abandoned.

[51] Int. Cl.[3] ..... F15B 11/16

[52] U.S. Cl. ..... 137/117; 91/446; 137/596.13

[58] Field of Search ..... 137/115, 117, 596.12, 137/596.13; 91/446, 447

[56] References Cited

U.S. PATENT DOCUMENTS

| | | | |
|---|---|---|---|
| 2,941,547 | 6/1960 | Rood | 137/596.13 |
| 3,225,781 | 12/1965 | Kruger et al. | 137/596.13 |
| 3,283,773 | 11/1966 | Lowman | 137/117 |
| 3,455,210 | 7/1969 | Allen | 137/117 X |
| 3,465,519 | 9/1969 | McAlvay | 137/117 X |
| 3,602,104 | 8/1971 | Stremple | 137/117 X |
| 3,618,628 | 11/1971 | Kramer | 137/117 X |
| 3,777,773 | 12/1973 | Tolbert | 137/117 |
| 3,847,180 | 11/1974 | Kroth et al. | 137/596.13 |
| 3,951,162 | 4/1976 | Wilke | 137/596.13 X |

*Primary Examiner*—Robert G. Nilson

*Attorney, Agent, or Firm*—Merchant, Gould, Smith, Edell, Welter & Schmidt

[57] ABSTRACT

A hydraulic valve of the type having a plurality of flow directing spools and valve bodies, normally disposed in a stack, or sectional control valve assembly, with registering like passageways on adjacent valve bodies in fluid communication. An open center pilot arrangement is provided to initially control the pressure of fluid supplied to an output passageway of an individual valve when its spool is moved to a position to supply fluid to a load connected thereto. A balanced flow control is disposed in each valve body between an inlet passageway and an outlet passageway and to a loop and an output passageway. The flow control is operative in response to the pressure in one of the output passageways of the valve body to control the proportionate flow of the fluid to the output passageway and the outlet passageway of the valve body. A number of individual valves may be operated in a stack in such a manner that an "upstream" valve will have "priority". Under such conditions two or more valves may be operative simultaneously as long as the total fluid demanded does not exceed the source of supply. Should the demand exceed the source of supply, the valves will operate in sequence.

20 Claims, 16 Drawing Figures

HYDRAULIC VALVE HAVING PRESSURE COMPENSATED DEMAND FLOW

This is a continuation of application Ser. No. 870,765 filed Jan. 19, 1978 now abandoned which is a continuation of Ser. No. 793,381 filed May 4, 1977, now abandoned which is a continuation of Ser. No. 631,021 filed Nov. 12, 1975 now abandoned, which is a continuation of Ser. No. 509,834, filed Sept. 27, 1975, now abandoned, which is a continuation of Ser. No. 231,174, filed Mar. 2, 1972 now abandoned.

SUMMARY OF THE INVENTION

A hydraulic valve assembly which may be operable under conditions wherein each of a plurality of individual valve assemblies, supplied from a common source and operative to operate a like plurality of individual load means, may be operable to supply fluid under pressure to individual load means in sequence or at different rates and pressures as long as the total of the individual rates and pressures does not exceed the capacity of the common source of supply.

A flow control associated with each individual valve is operative in response to the demand of such valve to satisfy such demand as long as the fluid supplied to it exceeds the demand of the load imposed by such valve and by the load means to which it is connected.

This is accomplished by means rendering the flow control means operative in accordance with a differential in pressure between the source of fluid to which it is connected and the combined fluid pressure in the load means, to be supplied with fluid, and suitable biasing means.

The flow control means in each valve is operative in at least two modes. It may "meter out", that is control the flow of fluid between the high pressure inlet and outlet ports in a valve while supplying fluid to a high pressure loop or; it may "meter in", that is control the flow of fluid from a high pressure loop while allowing the rest of the fluid to flow directly from the high pressure inlet to the high pressure outlet on the valve due to an increase in pressure at such high pressure outlet.

Provision may also be made to allow the flow control to operate as a pressure relief valve where, for example, an auxiliary pilot relief is included in a duct that serves to connect the pressure of the fluid in a load means to the flow control means so that when the pressure in a load means exceeds a predetermined maximum value that is less than the maximum pressure of a source of fluid, the flow control valve is operative to bypass all of the fluid directly to the high pressure outlet.

These and other features of my invention will become apparent from a consideration of the appended description of a preferred embodiment, claims and drawings in which:

Figure 1:
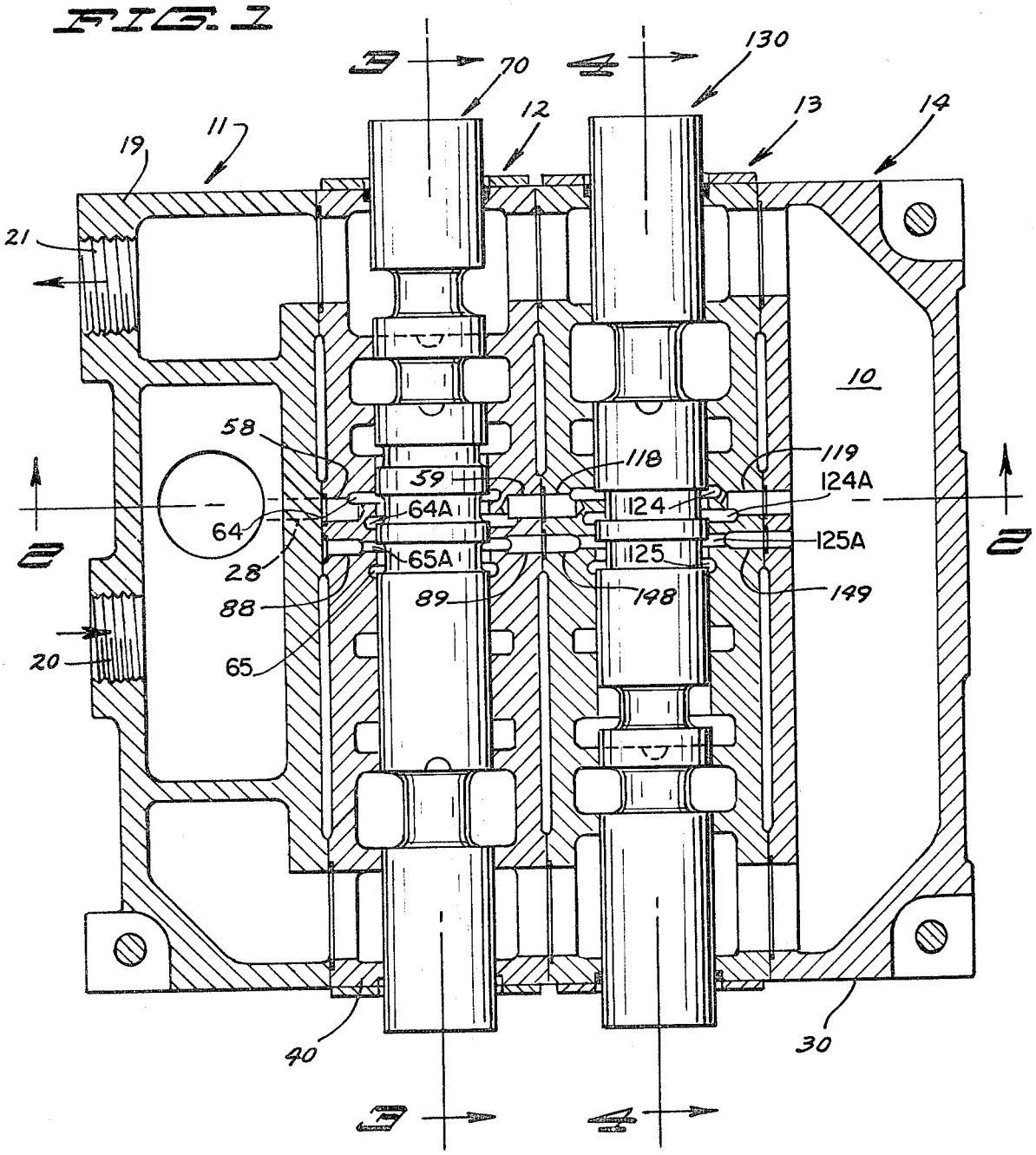
FIG. 1 is a sectional plan view of a valve assembly incorporating the features of my invention.

Referring now to the drawings, there is shown a sectional stack valve assembly 10 comprised of an inlet section 11, a float valve section 12, a regeneration valve section 13 and an outlet section 14.

Figure 2:
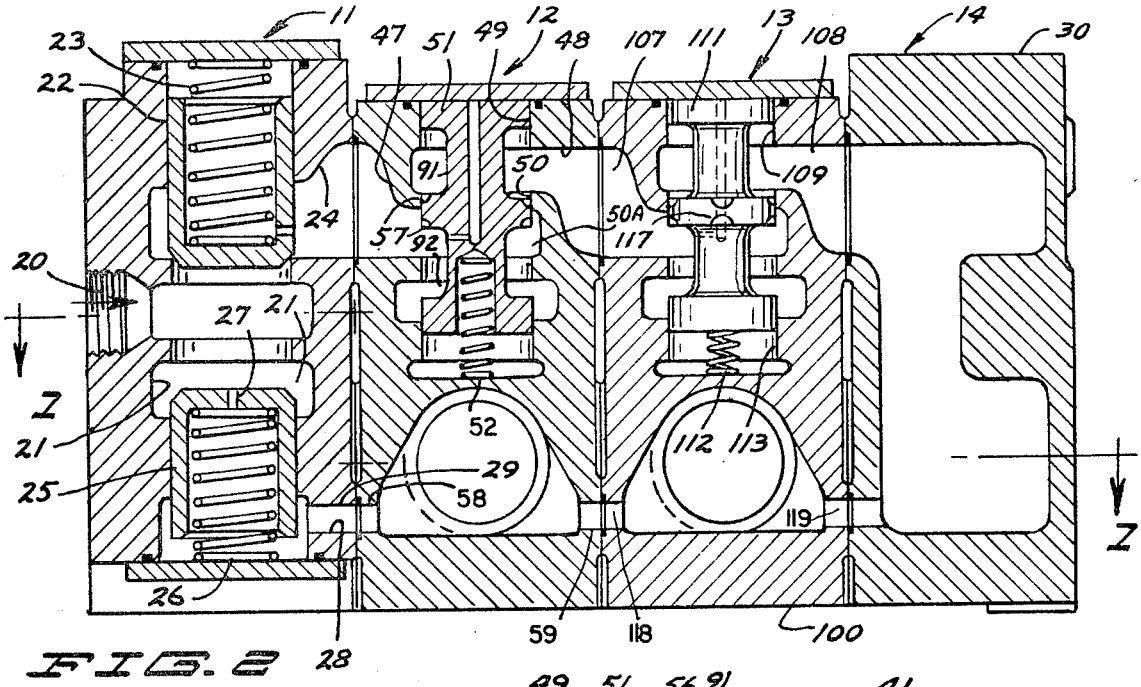
FIG. 2 is a sectional view taken along section lines 2—2 on FIG. 1 of the drawings.
Figure 3:
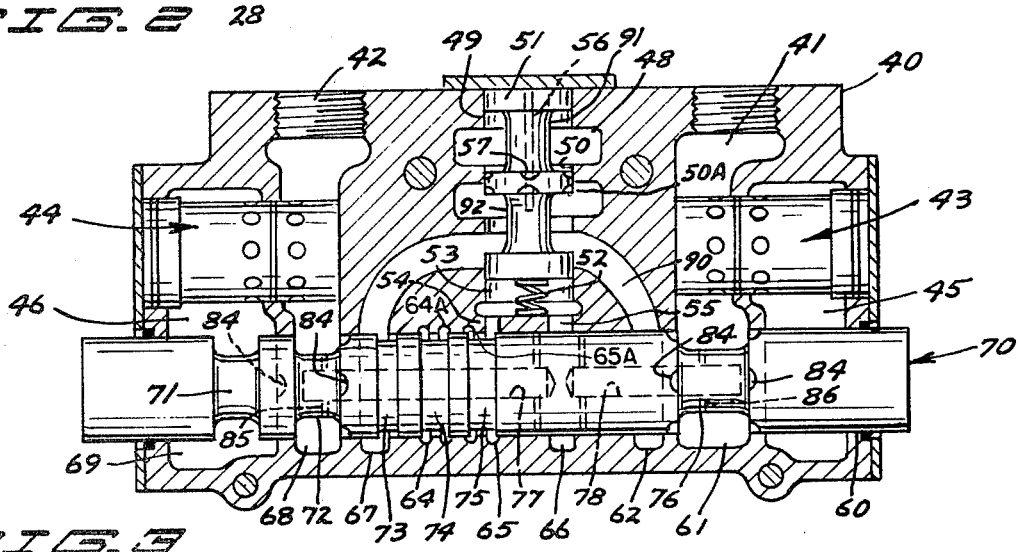
FIG. 3 is a sectional view of a float valve assembly taken along section lines 3—3 on FIG. 1 of the drawings.

Inlet section 11 is shown in FIGS. 1 and 2 of the drawings as comprising a body 19 having an inlet or pump port 20 and a return or exhaust port 21. Inlet section body also has a high pressure outlet passageway 24 and a load check valve 22 is shown biased downwardly toward a valve seat disposed between inlet port 20 and high pressure outlet passageway 24 and biased in such position by a load check valve spring 23. Inlet section body 19 also includes a low pressure open center pilot passageway 28 which is in fluid communication with a chamber on the inside of an open center poppet valve 25, having an orifice 27, which is normally biased to engage a valve seat disposed intermediate inlet port 20 and exhaust port 21 through suitable biasing means shown as open center poppet valve spring 26.

Outlet section 14 is shown having a body 30 which contains a chamber 10 which is connected to the return or sump of a hydraulic pump through means not shown and which is also in fluid communication with the exhaust parts on an adjacent individual valve section 13, which may be connected to a load means such as a cylinder, an open center pilot passageway and an outlet or a dump passageway from a flow control means. While the several apertures accomplishing this function are illustrated on the right ends of FIGS. 1 and 2, the location and size are easily determined by one skilled in the art and therefore the individual apertures have not been identified by reference characters for the purposes of reducing the complexity of the illustration.

Figure 4:
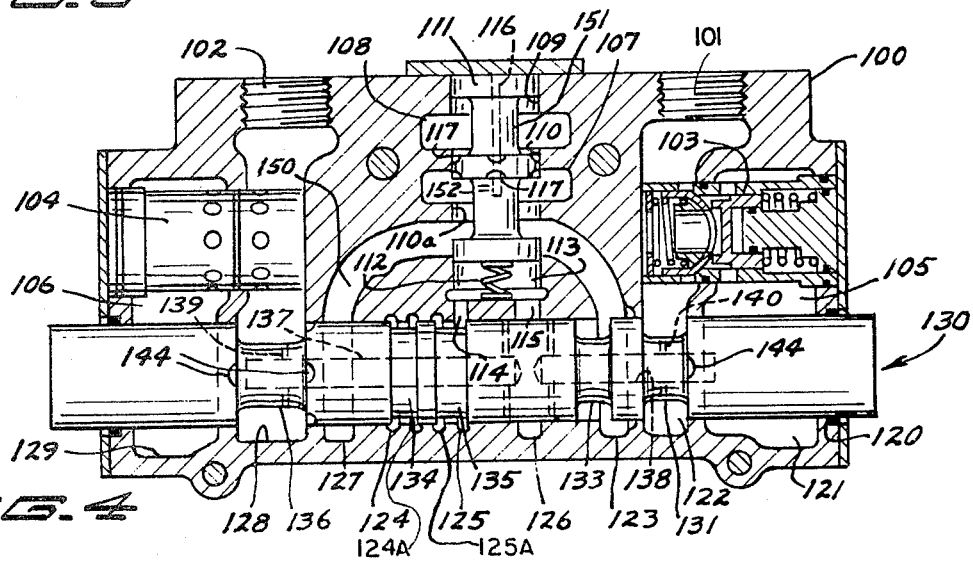
FIG. 4 is a sectional view of a regeneration valve taken along section lines 4—4 on FIG. 1 of the drawings.

A valve shown as a float valve section 12 is comprised of a float section body 40 having right and left output load cylinder ports and passageways 41 and 42, right and left return or exhaust passageways 45 and 46 and, a high pressure passageway having an inlet 47 and an outlet 48. Anticavitation and relief valves 43 and 44 are shown disposed between right cylinder passageway 41 and exhaust passageway 45 and left cylinder passageway 42 and exhaust passageway 46, respectively. The reader is referred to element 103 on the right end of FIG. 4 of the drawings for the details of a suitable anticavitation and relief valve which may be utilized in any of the illustrative valves of the preferred embodiment.

A flow control bore 49 is shown disposed intermediate high pressure inlet 47 and high pressure outlet 48 and a high pressure loop 90. High pressure outlet 48 has a bore portion 50 disposed between it and high pressure inlet 47 and a further bore portion 50A is disposed between high pressure inlet 47 and loop 90. A flow control spool 51 is shown having a top groove 91 and a lower groove 92 and a spring biasing means 52 disposed between the lower portion thereof and the bottom of a lower chamber 53. Flow control spool 51 also includes a passage orifice 56 extending from bottom groove 92 upwardly and axially to the top end thereof. Suitable radially inwardly extending and axially extending metering grooves 57 are disposed on the outer surface of flow control spool 51 on adjacent edges of grooves 91 and 92. Lower chamber 53 is shown having downwardly opening dump and pressure passageways 54 and 55.

Float section body 40 is also provided with an axially extending bore 60 which includes a plurality of annular grooves which are in fluid communication with various passageways as will be described below. Bore 60 includes right and left exhaust grooves 45 and 46, right and left load cylinder grooves 61 and 68, right and left high pressure grooves 62 and 67, open center pilot grooves 64 and 64A, flow control grooves 65 and 65A and a flow control high pressure groove 66. As may be inferred from the descriptive names, exhaust grooves 45 and 46 are connected to an exhaust passageway, load cylinder grooves 61 and 68 are connected to load output ports 41 and 42, high pressure grooves 62 and 67 are connected to loop 90, open center pilot grooves 64 and 64A are disposed intermediate pilot inlet 58 and pilot outlet 59, flow control grooves 65 and 65A are connected to dump passage 54 at the lower end of the flow control bore 49 and are disposed intermediate flow dump inlet 88 and flow dump outlet 89, and flow control pressure groove 66 is connected to passageway 55 on the lower end of flow control bore 49.

A spool member, indicated generally by reference character 70, is reciprocably mounted in bore 60 and includes a plurality of axially disposed grooved portions, proceeding from left to right, a left control groove 71, a further control groove 72, a float groove 73, a pilot open center groove 74, a flow control groove 75, and a right control groove 76. A transverse orifice 85 an internal axial and passage 77 are disposed intermediate control groove 72 and a position adjacent the center of spool 70, and a like transverse orifice 86 and axial passage 78 extend intermediate control groove 76 and a position adjacent the center of spool 70. A plurality of radially inwardly extending and axially elongated metering grooves 84 are shown disposed at appropriate locations adjacent the edges of control grooves 71, 72 and 76 for purposes to be explained below.

A further valve, shown as a regenerative valve section 13, includes a regenerative valve section body 100 having a right cylinder output port and passageway 101, a left cylinder output port and passageway 102, a right return or exhaust passageway 105, a left return or exhaust passageway 106, a right anticavitation and relief valve assembly 103 and a left anticavitation and relief valve assembly 104 disposed intermediate the respective cylinder output port passageways and exhaust passageways respectively. Regenerative valve section body also includes a high pressure passageway having an inlet 107, an outlet 108, a pilot inlet 118, a pilot outlet 119, a flow dump inlet 148 and a flow dump outlet 149.

A flow control bore 109 is disposed in regenerative valve section body 100 through high pressure inlet and outlet passageways 107 and 108, to loop passageway 150. Flow control bore 109 includes land portions 110 and 110A for purposes to be described below. A flow control spool 111 is shown having a top groove 151 and a bottom groove 152 and an orifice, 116, extending from the top thereof to groove 152. Flow control bore 109 also includes a lower chamber 113 having a dump passageway 114 and a pressure passageway 115. Suitable metering grooves 117 are disposed to extend radially inwardly and axially of the portions of flow control spool 111 adjacent to and opening into top and bottom grooves 151 and 152.

Regenerative valve section body 100 also includes a bore 120 having right and left exhaust grooves 121 and 129, right and left cylinder grooves 122 and 128, right and left high pressure grooves 123 and 127 connected to loop 150, open center pilot grooves 124 and 124A, flow control dump grooves 125 and 125A, and a flow control pressure groove 126.

A spool indicated generally by reference character 130 is reciprocably disposed in bore 120 and includes, reading from left to right, a left control groove 136, an open center pilot groove 134, a flow control groove 135, a regenerative groove 133 and a right control groove 131. A transverse orifice 139 and an internal axial passage 137 extend intermediate left control groove 136 and a point in proximity to the center of spool 130. A further transverse orifice 140 axial and passage 138 extend intermediate right control groove 131 and a position in proximity to the center of spool 130. A plurality of radially inwardly extending axially elongated metering grooves 144 are disposed in proximity to the edges of control grooves 131 and 136.

It may thus be seen that the complete stack valve assembly illustratively discloses the elements of my invention in FIGS. 1, 2, 3 and 4 of the drawings.

In these figures, the apparatus is shown in a neutral position in which hydraulic fluid under pressure is applied to inlet port 20, valve spools 70 and 130 are in their neutral position, check valve 22 is in its lowermost position in which it will block the flow of fluid under pressure to the flow control valve assemblies in each of valves 12 and 13, poppet relief valve 25 is forced downwardly away from its seat to allow fluid under pressure to proceed directly from high pressure inlet port 20 to exhaust passageway 21, fluid under pressure is admitted through orifice 27 in poppet relief valve 26 to the passageways connected to the pilot open center lands in valves 12 and 13, to outlet section 14, and the dump passageways 54 and 114 associated with each of the flow control bores in valves 12 and 13 are likewise connected directly to outlet section 14.

Before proceeding with the operation of the several illustrative examples to be described below, attention is directed to a further auxiliary relief valve, indicated generally by reference character 160 on FIGS. 7, 9, 13 and 15. As shown in these figures, auxiliary relief valve 160 is comprised of a plug member 161 and a ball check 163 that is biased to close one end of an axial duct 164. Ball check 163 may be unseated to connect axial duct 164 to radial duct 165. The entire relief valve may be disposed in suitable bores formed in one or both ends of valve spools 79 and 130 so that axial duct 164 is in fluid communication with the axial passageways 77 and 137 formed in each of them. When the auxiliary relief valves are provided in the manner shown, they serve to provide a pressure relief for a specific output port as will be set forth below. A similar valve, not shown, may be disposed in fluid communication with the lower end of poppet open counter valve 25 to be operable at a predetermined pressure therein to bypass fluid to enable poppet open center valve to assure the full bypass position of FIG. 2 of the drawings.

OPERATION OF FIGS. 5, 6 AND 7

Figure 5:
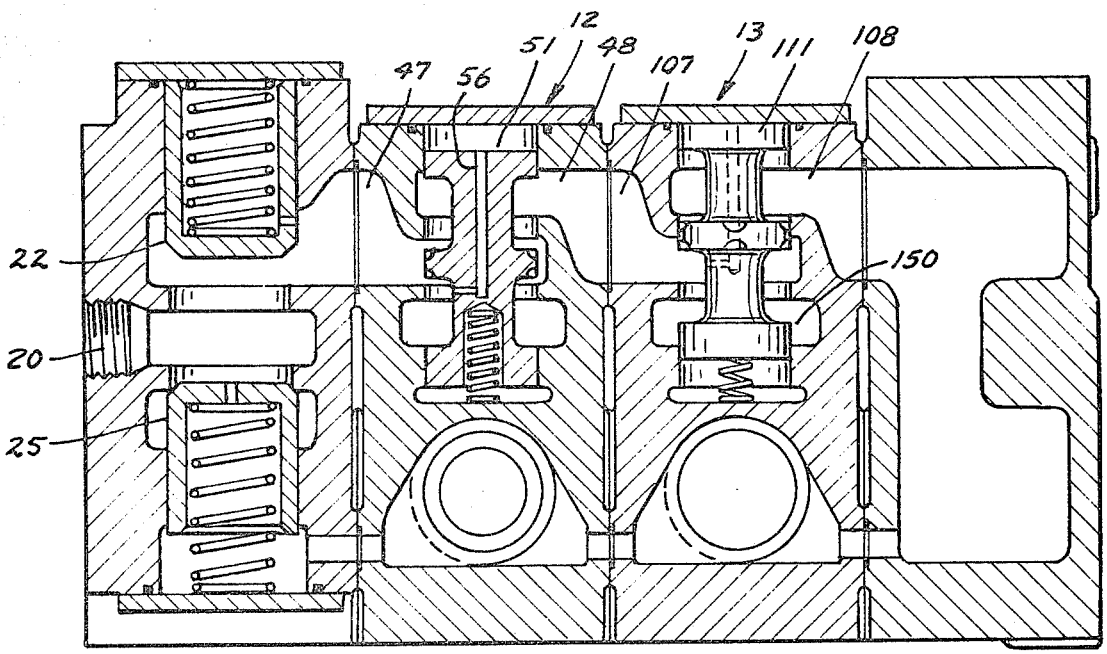
FIGS. 5, 6 and 7 are sectional views similar to those illustrated in FIGS. 2, 3 and 4 illustrating the respective disposition of the elements under a first mode of operation.
Figure 6:
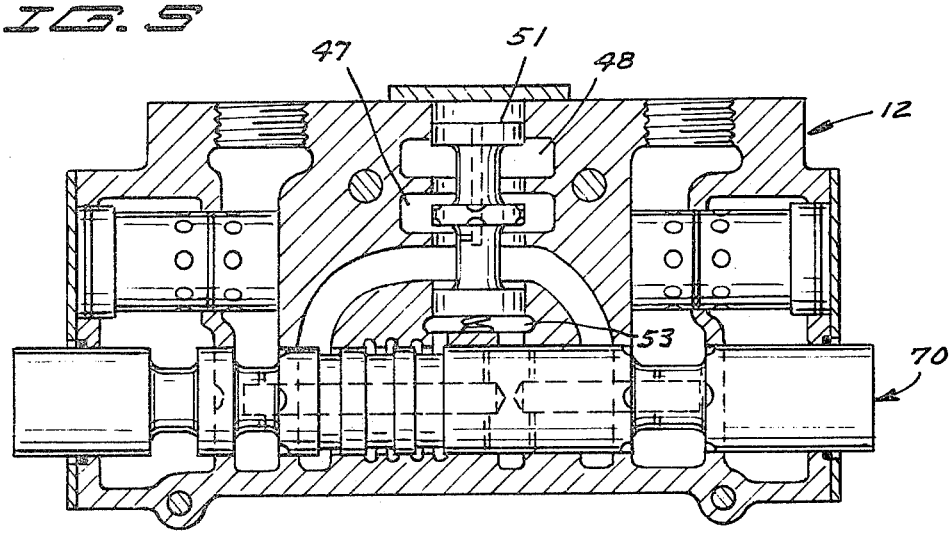
Figure 7:
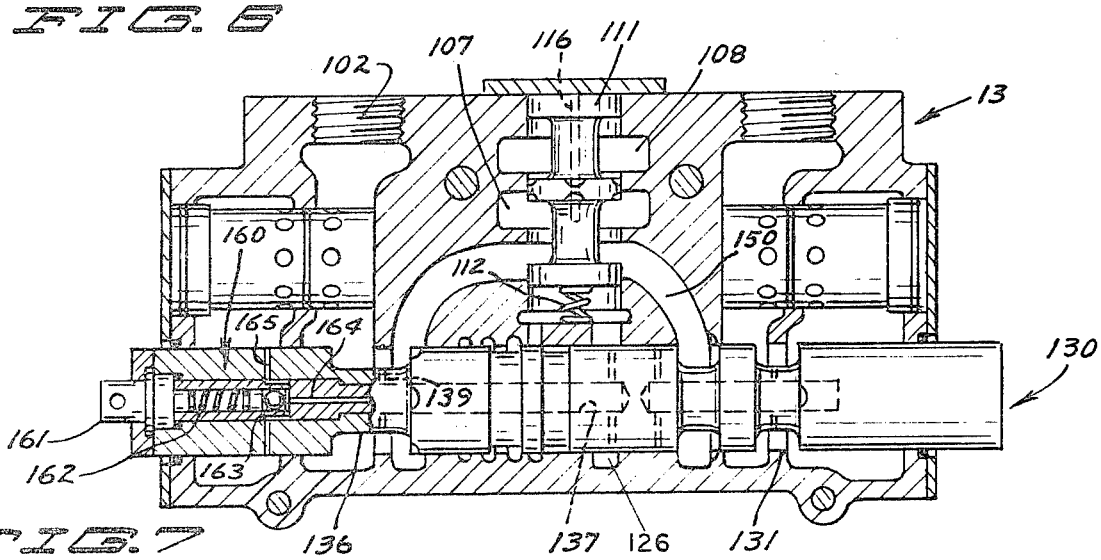

In FIGS. 5, 6 and 7, spool 70 is shown in its neutral position and spool 130 is in a position to connect loop 150 to cylinder output port 102 and to simultaneously block pilot open center groove 124. This causes pressure to rise on the lower end of poppet relief valve 25 to cause it to move upwardly to block the flow of fluid under pressure from high pressure inlet 20 to exhaust. This in turn causes check valve 22 to rise, to allow fluid under pressure to flow into high pressure inlet 47 in valve 12. Since spool 70 in valve 12 is in its neutral position, pressure will be applied through orifice 56 in flow valve spool 51 to the top portion thereof to cause it to move downwardly against the biasing force exerted by spring 52 so that fluid will flow from high pressure inlet 47 directly to high pressure outlet 48 and thence to high pressure inlet 107 in valve 13. Chamber 53 at the lower end of flow control spool 51 is connected to exhaust through dump passageway 54 at this time so flow control that spool 51 will rapidly assume the position shown in FIGS. 5 and 6 of the drawings.

Flow control spool 111 in valve 13 will remain in its upper position to direct fluid under pressure to loop 150 and through groove 136 to cylinder output port 102. During this time, chamber 113 under spool 111 is connected to output port 102 through duct 137 and orifice 139 in spool 130 to provide an upwardly directed force on flow control spool 111 which combines with that provided by biasing spring 112. When the pressure in output port 102 rises, as near the end of the stroke of a load means such as a cylinder, relief valve 160, provided in the left end of spool 130, is actuated to release the pressure in duct 137 connected to chamber 113. As this occurs, the pressure present at groove 152 on spool 111 will begin to exceed the upward forces exerted upon spool 111 and fluid under pressure will flow through orifice 116 to the top end of spool 111 causing it to move downwardly and consequently to assure a position which will allow all or part of the fluid to flow from high pressure inlet 107 to high pressure outlet 108 and then to exhaust.

OPERATION OF FIGS. 8, 9, 10

Figure 8:
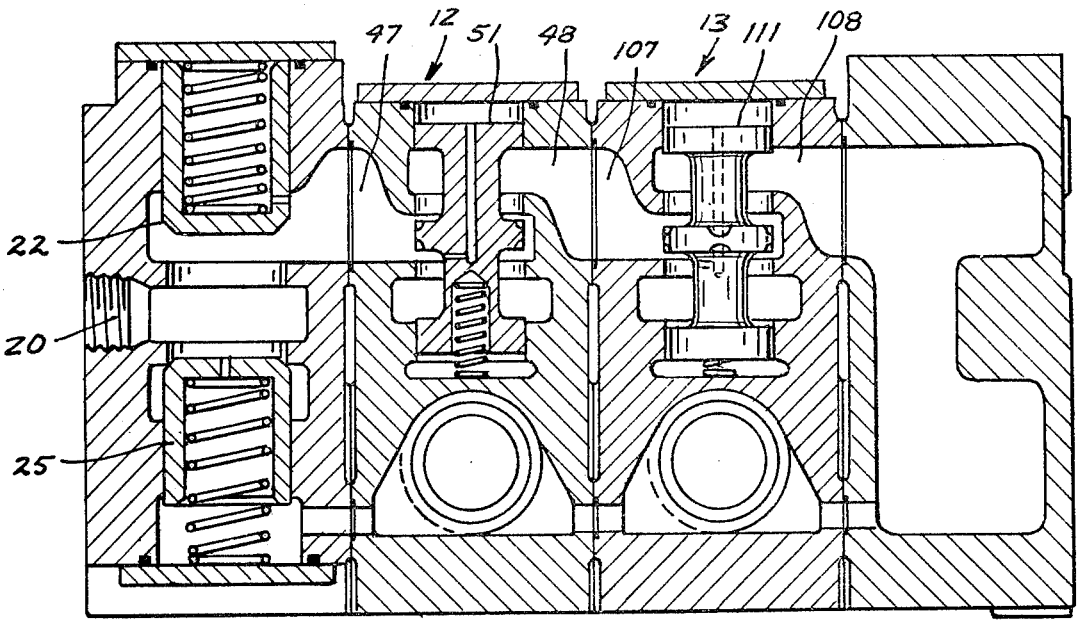
FIGS. 8, 9 and 10 are like sectional views illustrating the disposition of the respective elements under a second mode of operation.
Figure 9:
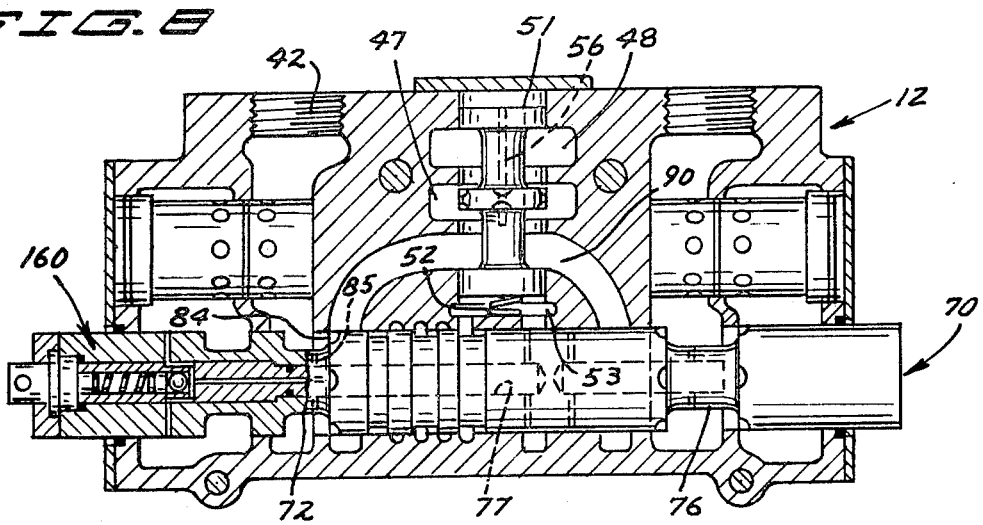
Figure 10:
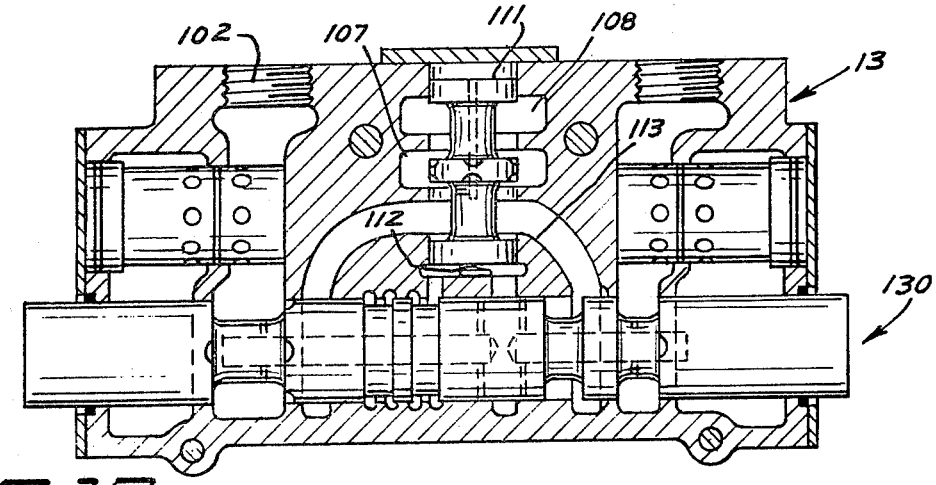

In FIGS. 8, 9 and 10, spool 70 on valve 12 is positioned so as to allow the flow of fluid from loop 90 to output port 42 through metering grooves 84 at the reduced rate, for example, 10 gallons per minute. With the spool in the position shown in FIG. 9, output port 42 is connected to the bottom chamber 53 in flow control bore 49 through orifice 85 and duct 77. Open center pilot groove 64 is closed so that poppet valve 25 will move upwardly to cause an increase in pressure in inlet port 20 to operate check valve 22 to apply high pressure fluid to high pressure inlet 47.

High pressure fluid flows through passage 56 in spool 51 to cause flow control valve 51 to move downwardly. High pressure fluid will continue to flow into loop 90 and through groove 84 on spool 78 to output port 42. The pressure at output port 42, that is transmitted to chamber 53 through orifice 85 and duct 77, and the force of biasing spring 52 combine to balance the force applied to the top end of spool 51 so that only the fluid that is necessary to maintain the flow to output port 42 is supplied to loop 90. The remainder of the fluid is transmitted through the flow control valve to high pressure outlet 48 and high pressure inlet 107 in valve 13.

Spool 130 on valve 13 is shown in its neutral position so that chamber 113 in flow control valve bore 109 is connected to exhaust through dump passageway, and any pressure in excess of that required to overcome the bias of flow control valve spring 112 serves to displace flow control valve spool 111 downwardly to directly connect high pressure inlet 107 to high pressure outlet 108 and thence to exhaust.

OPERATION OF FIGS. 11, 12, 13

Valve spool 70 is positioned, for example, to meter an increased amount, for example, 20 gallons per minute to output port 42 on valve 12 through metering grooves 84. As with FIG. 9, output port 42 is connected to chamber 52 at the bottom of flow control bore 49 through orifice 85 and duct 77, and open center pilot groove 64 is closed to enable open center poppet valve 25 and load check valve 22 to operate in the manner previously described. Spool 130 in valve 13 is shown in to a full power position to transmit as much fluid as possible from loop 150 to output port 102. Initially, the operation of valve 12 is similar to that just described in connection with FIGS. 5, 6 and 7.

Figure 11:
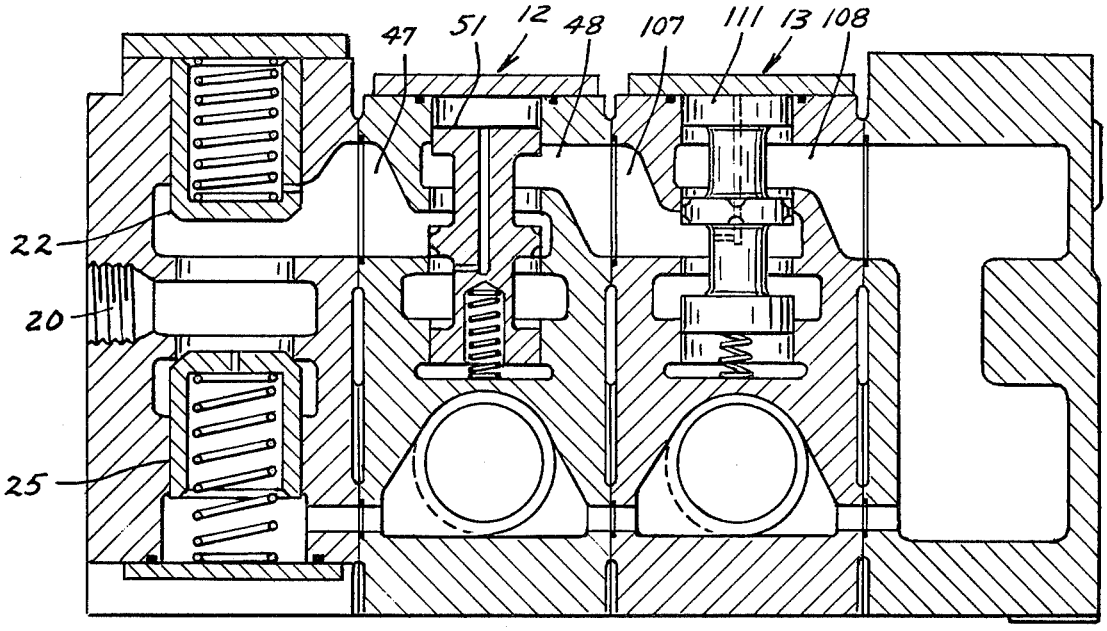
FIGS. 11, 12 and 13 are like sectional views illustrating the respective disposition of the elements under a third mode of operation.
Figure 12:
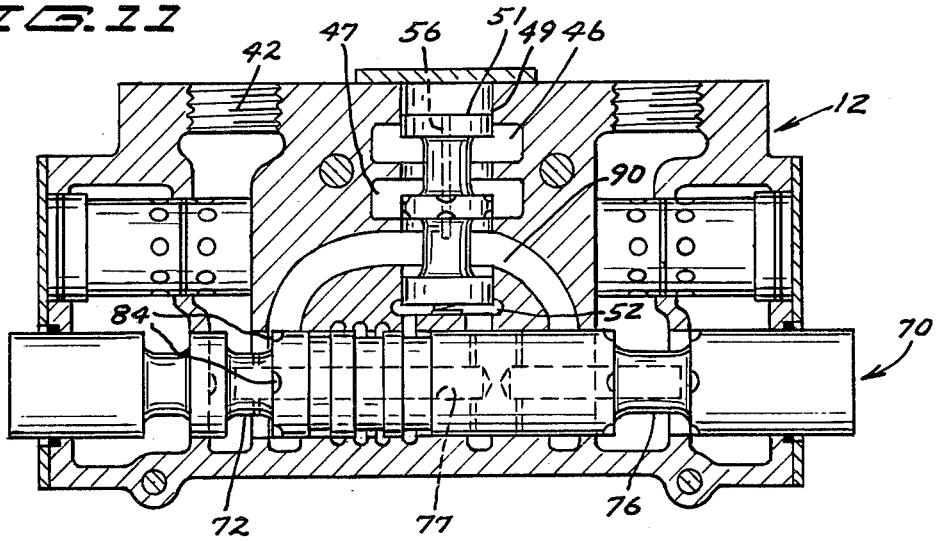
Figure 13:
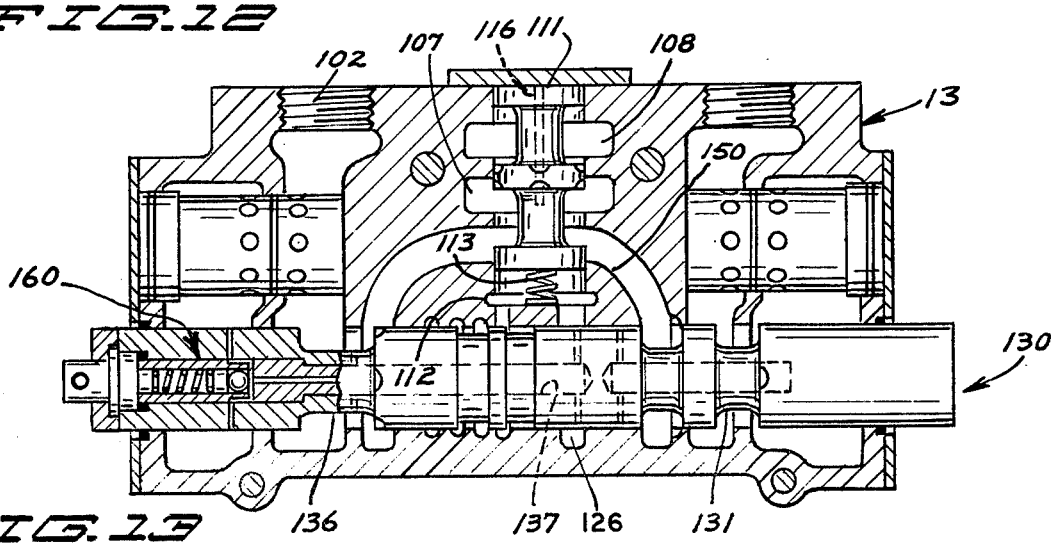

The excess fluid is supplied to high pressure outlet 48 on valve 12 and proceeds to high pressure inlet 107 on valve 13. The pressure at high pressure outlet 48 and high pressure inlet 107 may rise to a fairly high value since the pressure required at outlet port 102 on valve 13 may be higher than that required for the reduced flow and pressure demanded to satisfy output port 42 on valve 12. This results in an increase in pressure in loop 90 in valve 12 which is transmitted through orifice 56 to the top of flow control valve 51 is valve 12 to cause it to move downwardly to the position of FIGS. 11 and 12. This will allow more fluid to flow at a higher pressure to high pressure inlet 107 on valve 13, and, since spool 130 is positioned to direct a maximum flow to output port 102, flow control spool 111 remains at its uppermost position to direct the entire flow into loop 150 and thence through groove 136 to output port 102.

Initially the flow control will bypass excess fluid from valve 12 to valve 13. If the pressure requirement in valve 13 is greater than that of valve 12, valve 13 cannot accept the flow until pressure builds up to the load requirement. However, valve 12 will only accept demand flow. Pressure from increased metered flow through the spool of valve 12 will overbalance the flow control bias, and flow control valve 51 will move downward to maintain a pressure to satisfy the flow demand of 12 and to balance the flow control bias.

The operation is such that the valves are cascaded and the flow is divided between valves 12 and 13 in a manner determined by the demand requirements of the loads connected to output ports 42 and 102, respectively, and the flow of fluid to the various work loads will not be affected as long as the differential pressures which are necessary to operate the individual flow control valves are reached. It may further be noted that the assembly is essentially insensitive to variations of pressure demands between two or more valves.

At such time as the load connected to output port 102 or valve 13 reaches its limit of operation, relief valve 160, disposed in the left end of spool 130, is operable to bypass the fluid that has been applied to chamber 112 and the pressure of the fluid in high pressure inlet 107 is transmitted through duct 116 to the top of flow control spool 111. Flow control spool 111 will move downwardly to the second metering position described above and the excess fluid will be bypassed to exhaust through outlet 108.

OPERATION OF FIGS. 14, 15, 16

Figure 14:
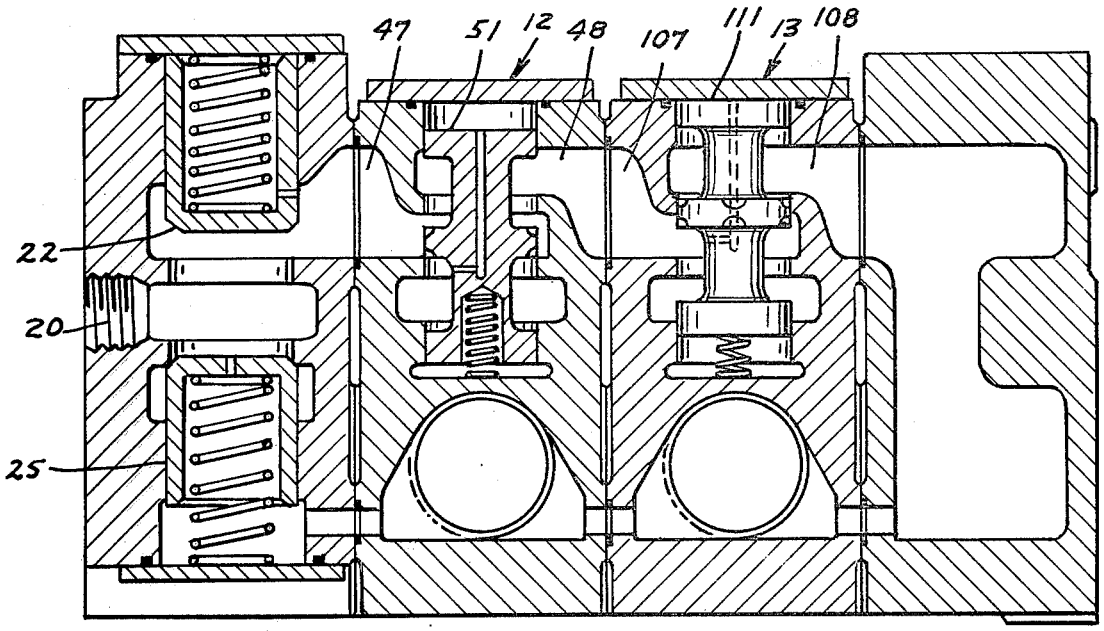
FIGS. 14, 15 and 16 are like sectional views illustrating the disposition of the elements under a fourth mode of operation.
Figure 15:
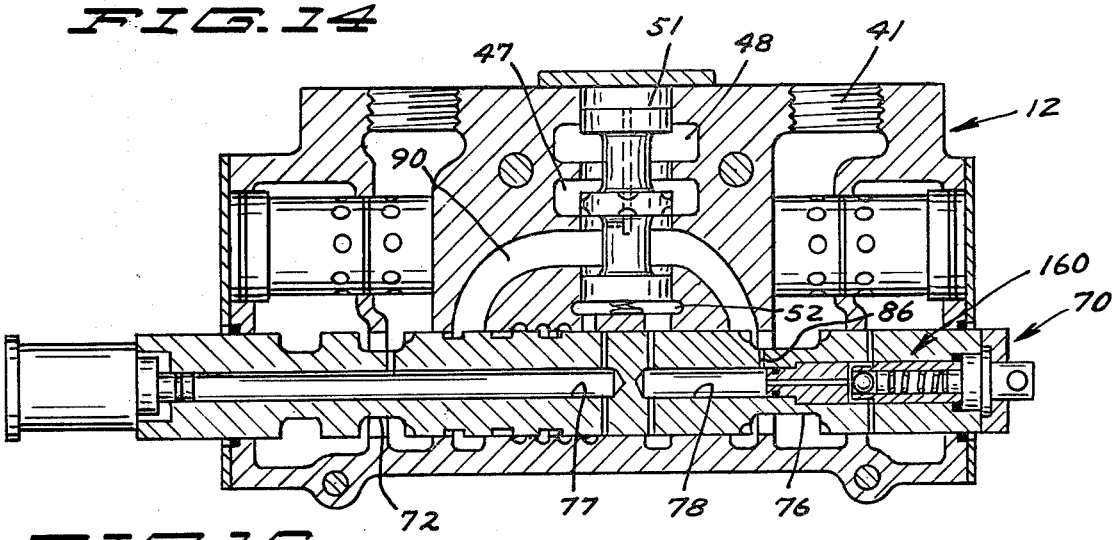
Figure 16:
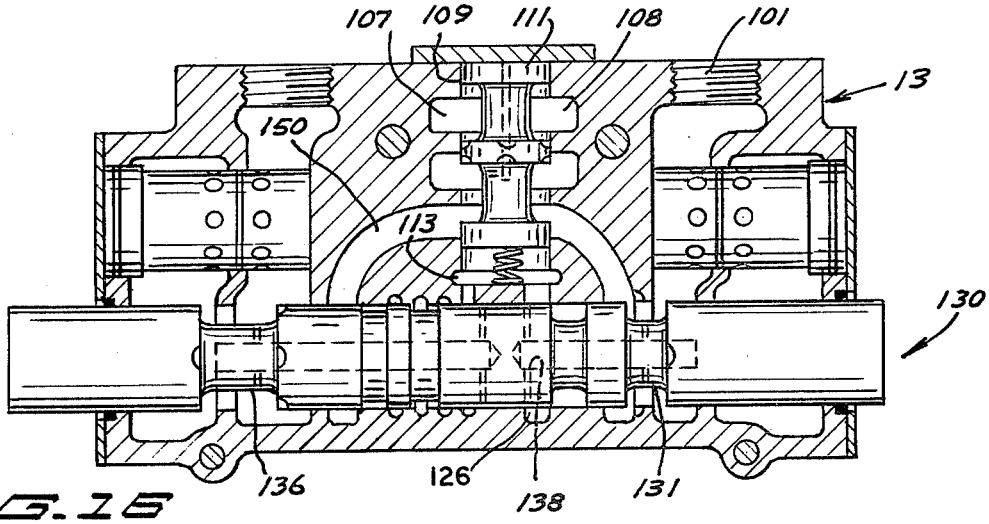

In the embodiment of FIGS. 14, 15 and 16, spool 70 on valve 12 is positioned so as to provide a full power flow of fluid from loop 90 to output port 41. Under such conditions of operation, open center pilot groove 64 is closed by spool 70. As may be seen in FIG. 15, spool 70 is also provided with relief valve 160 connected to duct 78 and orifice 86 and to exhaust passageway 45 in valve body 40. Valve spool 130 on valve 13 is likewise disposed to provide full flow from loop 150 to output port 101.

It may be noted that chamber 52 in flow control bore 49 is connected to output port 41 through orifice 86 and duct 78 and chamber 113 on flow control bore 109 is connected to output port 101 through duct 138 and orifice 140.

In the relationship of the elements shown in FIGS. 14, 15 and 16, the initial operation is as described above, open center poppet relief valve 25 is allowed to resume its seated position and check valve 22 is opened and these elements assume the position shown in the left end of FIG. 14 of the drawings.

Fluid under pressure is applied to high pressure inlet 47 on valve 12 and all of the fluid is initially supplied to output port 41 through loop 90 until such time as the workload connected to output port 41 is substantially satisfied. At this time, the pressure in output port 41 increases. This is in turn supplied to the pressure relief valve assembly disposed at the right end of valve spool 70 and the pressure therein will remain at the relief setting so that flow control spool 51 will tend to move downwardly.

At substantially the same time, the pressure in loop 90 is increasing to provide an additional force which will also tend to move flow control valve spool 51 downwardly to bypass more and more of the flow of fluid from inlet port 20 to high pressure inlet 107 on valve 13.

Initially, all of the fluid flows into loop 150. Should the fluid supplied exceed the demand requirements of the load connected, flow control spool 111 will become operative to bypass the excess fluid to exhaust. Further, if desired, a relief valve 160 may be disposed in the right end of spool 130 and the operation obtained above will result.

From the illustrative examples and drawings set forth above, it may now be apparent to those skilled in the art that my invention includes the features of a cascade operation, sequential operation, pressure relief and flow dividing while substantially reducing the power requirements in known present day systems and allowing operation under conditions of varying load demand requirements between individual loads controlled by the apparatus of my invention.

I claim:

1. Directional valve apparatus for controlling the flow of hydraulic fluid under pressure to and from a plurality of loads, comprising:

(a) a valve body defining a primary inlet for hydraulic fluid and a primary return outlet;

(b) a plurality of control valves for controlling the flow of hydraulic fluid to and from a load, each of said control valves comprising (i) an inlet;

(ii) an outlet;

(iii) a pair of load ports;

(iv) hydraulic fluid circuit means commonly communicating with said load ports;

(v) directional valve means variably movable between demand and nondemand positions for selectively delivering variable quantities of hydraulic fluid from the hydraulic fluid circuit means to one of the load ports, and for directing hydraulic fluid from the other port to return;

(vi) and flow control valve means comprising pressure responsive means communicating with the associated inlet, outlet and hydraulic fluid circuit means for proportioning hydraulic fluid from the inlet between the hydraulic fluid circuit means and outlet as a function of hydraulic fluid pressure at the associated inlet;

hydraulic fluid pressure at said return outlet;

hydraulic fluid pressure at the associated load port to which hydraulic fluid is delivered;

(vii) said flow control valve means further comprising biasing means for normally urging the flow control means to a position delivering all hydraulic fluid to the hydraulic fluid circuit means;

(c) said plurality of control valves being sequentially connected inlet to outlet with the inlet of the first in sequence in communication with said primary inlet, and the outlet of the last in sequence in communication with said primary return outlet;

(d) and bypass means including inlet valve means disposed between the primary inlet and primary return outlet for shunting flow directly to return if no directional valve means is in a demand position, and for directing the flow of hydraulic fluid to the inlet of the first control valve in sequence if any directional valve means is in a demand position.

2. The apparatus defined by claim 1, which further comprises control circuit means operable in conjunction with the respective directional valve means for:

(a) communicating return hydraulic fluid pressure to the pressure responsive means of any flow control valve means for which the associated directional valve means is in a nondemand position; or (b) communicating load port pressure to the associated pressure responsive means of any flow control valve means for which the directional valve means is in a demand position;

(c) and wherein each flow control valve means is operable to compare hydraulic fluid pressure at the associated inlet with hydraulic fluid pressure at the return outlet or hydraulic fluid pressure at the associated load port, and proportioning hydraulic fluid from the associated inlet between the associated hydraulic fluid circuit means and associated outlet as a function of such comparison.

3. The apparatus defined by claim 2, wherein the flow of hydraulic fluid proportioned by the flow control valve means to the associated outlet increases as the comparison in favor of inlet pressure increases.

4. The apparatus defined by claim 2, wherein each of said directional valve means comprises:

(a) a spool valve slidably disposed in a cylindrical bore;

(b) the associated load ports and hydraulic fluid circuit means being in communication with said bore;

(c) the spool valve comprising circumferential grooves and lands for interconnecting the load ports and hydraulic fluid circuit means.

5. The apparatus defined by claim 4, wherein each spool valve further comprises a plurality of metering grooves formed in one of said lands to permit metered flow between the hydraulic fluid circuit means and the selected load port.

6. The apparatus defined by claim 4, wherein the control circuit means comprises:

(a) a generally axially extending passage formed in the spool valve;

(b) and generally radially extending passages communicating with the axial passage and disposed for simultaneous communication with the associated load port to which hydraulic fluid is delivered and the pressure responsive means of the associated flow control valve means.

7. The apparatus defined by claim 6, and further comprising pressure relief means disposed in said spool valve in communication with said axially extending passage and in communication with said primary return outlet for relieving pressure at the associated load port to which hydraulic fluid is delivered when said pressure reaches a predetermined level.

8. The apparatus defined by claim 1, wherein each flow control valve means comprises:

(a) a spool valve slidably disposed in a cylindrical bore to define closed chambers at each end thereof;

(b) the associated inlet, outlet and hydraulic fluid circuit means being in communication with said bore;

(c) the spool valve including circumferential grooves and lands for interconnecting the inlet, outlet and hydraulic fluid circuit means;

(d) said biasing means comprising a spring disposed in one of said closed chambers;

(e) an orifice passage in the spool valve extending between one of said grooves and the other closed chamber to communicate inlet pressure thereto;

(f) said control circuit means being in communication with said one closed chamber.

9. The apparatus defined by claim 8, wherein each spool valve further comprises a plurality of metering grooves formed in one of said lands to permit metered flow between the inlet, outlet and hydraulic fluid circuit means.

10. The apparatus defined by claim 1, and further comprising normally closed check valve means having an upstream side and downstream side disposed between the primary inlet and the inlet of the first control valve for permitting the flow of hydraulic fluid thereto only if the upstream/downstream pressure differential reaches a predetermined minimum.

11. The apparatus defined by claim 10, wherein the check valve means comprises a spring biased poppet valve.

12. The apparatus defined by claim 1, wherein the inlet valve means comprises:

(a) normally closed check valve means having an upstream side and downstream side for permitting the flow of hydraulic fluid from the primary inlet to the primary return only if the upstream/downstream pressure differential reaches a predetermined minimum;

(b) an orifice passage extending between the upstream and downstream sides of the check valve means;

(c) and the bypass means further comprises pilot circuit means extending between the downstream side of the check valve means and said primary return outlet, and operable in conjunction with the respective directional valve means for establishing communication between said downstream side and primary return when all of said directional valve means are in a nondemand position, and for blocking communication therebetween when any of said directional valve means is in a demand position.

13. The apparatus defined by claim 12, wherein the normally closed check valve means comprises a spring biased poppet valve, and the orifice passage passes through the body of the poppet valve.

14. The apparatus defined by claim 1, wherein the valve body comprises a plurality of interconnectable and interchangable valve body sections, said primary inlet and primary return outlet in each of said control valves being respectively disposed in separate valve body sections.

15. Directional valve apparatus for controlling the flow of hydraulic fluid under pressure to and from a plurality of loads, comprising:

(a) a valve body defining a primary inlet for hydraulic fluid and a primary return outlet;

(b) a plurality of control valves for controlling the flow of hydraulic fluid to and from a load, each of said control valves comprising (i) an inlet;

(ii) an outlet;

(iii) a pair of load ports;

(iv) hydraulic fluid circuit means commonly communicating with said load ports;

(v) directional valve means variably movable between demand and nondemand positions for selectively delivering variable quantities of hydraulic fluid from the hydraulic fluid circuit means to one of the load ports, and for directing hydraulic fluid from the other port to return;

(iv) and flow control valve means comprising pressure responsive means communicating with the associated inlet, outlet and hydraulic fluid circuit means for proportioning hydraulic fluid from the inlet between the hydraulic fluid circuit means and outlet as a function of hydraulic fluid pressure at the associated inlet;

hydraulic fluid pressure at said return outlet;

hydraulic fluid pressure at the associated load port to which hydraulic fluid is delivered;

(vii) the flow control valve means being movable from a first normal position in which all hydraulic fluid is delivered to the hydraulic circuit means to a second position in which all hydraulic fluid is delivered to the outlet, and including metering means to progressively meter an increasing quantity of hydraulic fluid from the hydraulic circuit means to the outlet as the flow control valve means moves from the first to the second position;

(c) said plurality of control valves being sequentially connected inlet to outlet with the inlet of the first in sequence in communication with said primary inlet, and the outlet of the last in sequence in communication with said primary return outlet.

16. The apparatus defined by claim 15, wherein each flow control valve means comprises:

(a) a spool valve slidably disposed in a cylindrical bore to define closed chambers at each end thereof, said spool valve being movable between said first and second positions;

(b) the associated inlet, outlet and hydraulic fluid circuit means being in communication with said bore;

(c) the spool valve including circumferential grooves and lands for interconnecting the inlet, outlet and hydraulic fluid circuit means;

(d) a biasing spring disposed in one of said closed chambers to normally urge the spool valve to said first position; and (e) an orifice passage in the spool valve extending between one of said grooves and the other closed chamber to communicate inlet pressure thereto;

(f) said control circuit means being in communication with said one closed chamber.

17. The apparatus defined by claim 16, wherein the metering means comprises a plurality of metering grooves formed in one of the lands of said spool valve.

18. The apparatus defined by claim 15, which further comprises bypass means including inlet valve means disposed between the primary inlet and primary return outlet for shunting flow directly to return if no directional valve means is in a demand position, and for directing the flow of hydraulic fluid to the inlet of the first control valve in sequence if any directional valve means is in a demand position.

19. Directional valve apparatus for controlling the flow of hydraulic fluid under pressure to and from a plurality of loads, comprising:

(a) a valve body defining a primary inlet for hydraulic fluid and a primary return outlet;

(b) a plurality of control valves for controlling the flow of hydraulic fluid to and from a load, each of said control valves comprising (i) an inlet;

(ii) an outlet;

(iii) a pair of load ports;

(iv) hydraulic fluid circuit means commonly communicating with said load ports;

(v) a spool valve slidably disposed in a cylindrical bore formed within the control valve, the associated load ports and hydraulic fluid circuit means being in communication with said bore, the spool valve comprising circumferential grooves and lands and variably movable between demand and nondemand positions for selectively delivering variable quantities of hydraulic fluid from the hydraulic fluid circuit means to one of the load ports, and for directing hydraulic fluid from the other port to return;

(vi) flow control valve means comprising pressure responsive means communicating with the associated inlet, outlet and hydraulic fluid circuit means;

(vii) and control circuit means comprising first and second separate axial passage means formed in the spool valve, each constructed and disposed for establishing communication between one of said load ports and the associated flow control means when hydraulic fluid is being delivered to said one load port, the control circuit means being constructed and arranged for communicating return hydraulic fluid pressure to the pressure responsive means of any flow control valve means for which the associated spool valve is in a nondemand position; or communicating load port pressure to the associated pressure responsive means of any flow control valve means for which the spool valve is in a demand position;

(viii) each flow control valve means being operable to compare hydraulic fluid pressure at the associated inlet with hydraulic fluid pressure at the return outlet or hydraulic fluid pressure at the associated load port, and proportioning hydraulic fluid from the associated inlet between the associated hydraulic fluid circuit means and associated outlet as a function of such comparison;

(c) said plurality of control valves being sequentially connected inlet to outlet with the inlet of the first in sequence in communication with said primary inlet, and the outlet of the last in sequence in communication with said primary return outlet.

20. The apparatus defined by claim 19, wherein each spool valve further comprises a plurality of metering grooves formed in one of said lands to permit metered flow between the hydraulic fluid circuit means and the selected load port.

* * * * *

UNITED STATES PATENT AND TRADEMARK OFFICE

CERTIFICATE OF CORRECTION

PATENT NO. : 4,253,482

DATED : March 3, 1981

INVENTOR(S) : William T. Stephens

It is certified that error appears in the above-identified patent and that said Letters Patent are hereby corrected as shown below:

Column 2, line 14, the word "regeneration" should be changed to the word --regenerative--.

Column 4, line 41, the numeral "26" should be changed to the numeral --25--.

Column 4, line 57, the numeral "79" should be changed to the numeral --70--.

Column 4, line 65, the word "counter" should be changed to the word --center--.

Column 4, line 67, the word "assure" should be changed to the word --assume--.

UNITED STATES PATENT AND TRADEMARK OFFICE

CERTIFICATE OF CORRECTION

PATENT NO. : 4,253,482

DATED : March 3, 1981

INVENTOR(S) : William T. Stephens

It is certified that error appears in the above-identified patent and that said Letters Patent are hereby corrected as shown below:

Column 5, line 39, the word "assure" should be changed to the word --assume--.

Column 5, line 59, the numeral "78" should be changed to the numeral --70--.

Column 6, line 62, the word "or" should be changed to the word --on--.

Column 10, line 34, the word "other" should be changed to the word --outer--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*